US005771430A

United States Patent [19]

Iwakura

[11] Patent Number: 5,771,430

[45] Date of Patent: Jun. 23, 1998

[54] IMAGE FORMING APPARATUS WITH TONER TRANSFER

[75] Inventor: Yoshie Iwakura, Narashino, Japan

[73] Assignee: Sharp Kabushiki Kaisha, Osaka, Japan

[21] Appl. No.: 791,138

[22] Filed: Jan. 30, 1997

[30] Foreign Application Priority Data

Feb. 2, 1996 [JP] Japan ..... 8-017891

[51] Int. Cl.[6] ..... G03G 15/16

[52] U.S. Cl. ..... 399/31; 399/314

[58] Field of Search ..... 399/66, 298, 303, 399/304, 314

[56] References Cited

U.S. PATENT DOCUMENTS 5,390,012 2/1995 Miyashiro et al. ..... 399/303
5,623,329 4/1997 Yamauchi et al. ..... 399/314

FOREIGN PATENT DOCUMENTS 0708385 4/1996 European Pat. Off. .
5173435 7/1993 Japan .

*Primary Examiner*—Joan R. Pendegrass

[57] ABSTRACT

An image forming apparatus includes a photoreceptor drum having a toner image formed on its surface, a transfer drum having a dielectric layer, a semiconductive layer and a conductive layer arranged orderly, a power source section applying a predetermined voltage to the conductive layer, and a ground roller which is grounded and comes in contact with the surface of the dielectric layer through a transfer paper. In addition, in the image forming apparatus, a foaming body having elastic property is used for the semiconductive layer, and a diameter of foams in the semiconductive layer is controlled within the range of between 200 μm and 400 μm. Alternatively, the average micro-gap (which is obtained by equalization of a micro-gap formed between the semiconductive layer and the dielectric layer) may be controlled within the range of between 20 μm and 50 μm. Consequently, a stable electrostatic attraction of the transfer paper to the transfer drum is achieved, and unsatisfactory transfer of the toner image onto the transfer paper is prevented. The image forming apparatus realizes an excellent image formation onto the transfer paper, and the arrangement capable of reduction of the manufacturing cost.

19 Claims, 8 Drawing Sheets

IMAGE FORMING APPARATUS WITH TONER TRANSFER

FIELD OF THE INVENTION

The present invention relates to an image forming apparatus used for a variety of devices, such as a laser printer, a copying machine or a laser facsimile machine, and more specifically relates to an arrangement of transfer means such as a transfer drum to carry out a plurality of times of toner transfers while holding a transfer paper.

BACKGROUND OF THE INVENTION

Conventionally, there exists an image forming apparatus which carries out a development operation through adhesion of a toner to an electrostatic latent image formed on a photoreceptor drum. Toner image formed in such manner is transferred onto a transfer paper rolled up around a transfer drum.

As shown in FIG. 11, such image forming apparatus includes corona chargers 102 and 104 inside a cylinder 101 having a dielectric layer 101*a*. The corona chargers 102 and 104 are disposed at different positions away from each other. The corona charger 102 attracts a transfer paper 'P', while the corona charger 104 transfers a toner image formed on the surface of a photoreceptor drum 103 onto the transfer paper 'P'. Thus, attraction of the transfer paper 'P' by the corona charger 102 is carried out independently of transfer onto the transfer paper 'P' by the corona charger 104.

FIG. 12 shows another image forming apparatus having a cylinder 201 and a grip mechanism 202. The cylinder 201 has a two-layered structure made of a semiconductive layer 201*a* which is an outer layer, and a base material 201*b* which is an inner layer. The grip mechanism 202 holds a transfer paper 'P', when it has been carried, along the cylinder 201. In this type of image forming apparatus, when the transfer paper 'P' has been carried, its end portion is gripped by the grip mechanism 202 so that the transfer paper 'P' goes along the surface of the cylinder 201. Then, the surface of the cylinder 201 is charged by voltage application to the semiconductive layer 201*a* as the outer layer of the cylinder 201, or by discharge of a charger provided inside the cylinder 201. Thus, the toner image on a photoreceptor drum 103 is transferred onto the transfer paper 'P'.

However, in the image forming apparatus shown in FIG. 11, it is necessary to provide the aforementioned corona chargers 102 and 104 inside the cylinder 101 as a transfer roller because the cylinder 101 has a single-layered structure made of only the dielectric layer 101*a* . For this reason, there arise problems that the cylinder 101 is limited in miniaturization of its size and thus the apparatus cannot be made smaller.

In the image forming apparatus shown in FIG. 12, the cylinder 201 as a transfer roller has a two-layered structure and, as a result, the cylinder 201 is charged by smaller number of chargers (i.e., single charger) in order to transfer the toner image onto the transfer paper 'P'. However, with this arrangement, the whole arrangement of the image forming apparatus is complicated for providing the grip mechanism 202, thus presenting problems that the number of parts of the whole apparatus increases and that manufacturing costs of the apparatus rise up.

In order to solve the aforementioned problems, the following image forming apparatus is disclosed in Japanese Laid-Open Patent Application No. 173435/1993 (Tokukaihei 5-173435); the arrangement comprises a transfer drum which at least has a foaming-body layer and a dielectric layer covering said foaming-body layer, and forms a color image on a transfer paper by overlapped successive transfers of toner images, corresponding to each color, sequentially formed on a photoreceptor drum onto the transfer paper attracted on the transfer drum.

In such image forming apparatus, in order to hold the transfer paper on the transfer drum, the transfer paper is electrostatically attracted on the transfer drum by use of an attraction roller as charge supplying means. In addition, this type of image forming apparatus has a gap layer of not less than 10 $\mu$m in thickness between the foaming-body layer and the dielectric layer, in order to improve attraction force, i.e., attraction of the transfer paper.

However, in Japanese Laid-Open Patent Application No. 173435/1993, the thickness of the aforementioned gap between the foaming-body layer and the dielectric layer is obscurely defined; that is, it is only defined to be not less than 10 $\mu$m. This Application also suggests that the thickness up to several millimeters is included in a useful range. However, in general, the greater is amount (thickness) of such gap, the higher are (i) a toner transfer voltage required for transfer of the toner image onto the transfer paper and (ii) an application voltage required for stable electrostatic attraction of the transfer paper onto the dielectric layer. Accordingly, the image forming apparatus of Japanese Laid-Open Patent Application No. 173435/1993 has problems that it has disadvantage of costs in addition to having drawback in safety.

Furthermore, it is necessary to have at least two power sources in order to carry out in a stable and excellent condition (i) electrostatic attraction of the transfer paper to the transfer drum and (ii) transfer of the toner image onto the transfer paper. For this reason, there arise problems that costs for enlargement of the apparatus and manufacturing costs of the apparatus, rise up.

SUMMARY OF THE INVENTION

The object of the present invention is to provide an image forming apparatus which prevents bad transfer of a toner image onto a transfer paper and allows an excellent image to be formed on the transfer paper, through stable electrostatic attraction of the transfer paper to a surface of transfer means such as a transfer drum, with the arrangement that realizes reduction of manufacturing costs.

In order to achieve the foregoing object, an image forming apparatus of the present invention includes a photoreceptor drum for forming a toner image on a surface thereof.

There is a transfer drum for transferring the toner image formed on the photoreceptor drum onto a transfer paper. This is done by bringing the transfer paper into contact with the photoreceptor drum. The transfer drum has a dielectric layer, a semiconductive layer and a conductive layer placed in this order from a side of a surface coming in contact with the transfer paper.

There is a power source section connected to the conductive layer, for application of a predetermined voltage to said conductive layer, and a ground roller provided on an upstream side of a transfer position on a surface of the dielectric layer with respect to a carrying direction of the transfer paper, said ground roller coming in contact with the surface of the dielectric layer through the transfer paper and generating a potential difference between the transfer paper and the conductive layer to which the voltage is applied.

The semiconductive layer is made of a foaming body having elastic property, and a diameter of foams in the semiconductive layer is controlled within a predetermined range so that charge is successively supplied (injected) from a ground roller side to a transfer drum side even after Paschen's discharge of from the transfer drum side to the ground roller side. Preferably, the diameter of foams in the semiconductive layer is within the range of between 200$_{\mu}$m and 400$_{\mu}$m, in the foregoing image forming apparatus.

According to the foregoing arrangement, ① charge is accumulated in the semiconductive layer by application of the voltage to the conductive layer. When the transfer paper is carried between the transfer drum and the ground roller, and when the ground roller comes in contact with the dielectric layer through the transfer paper, then the charge accumulated in the semiconductive layer is moved to the dielectric layer, and the Paschen's discharge and the charge injection accompanying the Paschen's discharge take place. As a result, charge is induced to the transfer paper and thus the transfer paper is electrostatically attracted to the surface of the transfer drum through attractive force between the charge on the surface of the transfer paper and the charge caused by the application voltage applied by the power source section. Accordingly, if only application of the voltage to the conductive layer, it is possible to electrostatically attract the transfer paper to the surface of the dielectric layer, i.e., the surface of the transfer drum. The toner image is transferred to the transfer paper by the potential difference between (i) the charge caused by the application voltage applied by the power source section and (ii) the charge of the toner image on the surface of the photoreceptor drum.

Thus, unlike conventional arrangements, the foregoing arrangement does not adopt charge injection with use of air discharge for attraction of the transfer paper and transfer onto said transfer paper. Instead, according to the foregoing arrangement, attraction of the transfer paper and transfer onto said transfer paper is carried out through charge injection and local discharge at a nip (micro-gap) between the dielectric layer and the ground roller, which permits low voltage drive and also easy voltage control. Accordingly, the foregoing image forming apparatus can stably charge (electrify) the surface of the transfer drum and can stably attract the transfer paper and transfer onto said transfer paper, as compared with charge (electrification) due to induction of charge to the surface of the transfer drum by air discharge as in the conventional arrangements. In addition, the foregoing arrangement can improve transfer efficiency and image quality, since it is possible to reduce irregularity of voltage brought to the transfer drum. Occurrence of ozone is also diminished.

Furthermore, according to the foregoing arrangement, ② the single power source carries out (i) voltage application for electrostatic attraction of the transfer paper to the surface of the transfer drum and (ii) voltage application for transfer of the toner image formed on the photoreceptor drum onto the transfer paper. As a result, the foregoing image forming apparatus realizes reduction of manufacturing costs and miniaturization of the apparatus.

Furthermore, according to the foregoing arrangement, ③ a lot of charges can be supplied onto the surface of the transfer paper, since the semiconductive layer is formed by a foaming body having elastic property and preferably the diameter of foams in the semiconductive layer is within the range of between 200 $\mu$m and 400 $\mu$m. At the time of transfer, the curl in the opposite direction to the transfer drum is not brought to the transfer paper. As a result, the transfer paper can be stably attracted and held onto the transfer drum.

In order to achieve the foregoing object, another image forming apparatus of the present invention includes a photoreceptor drum for forming a toner image on a surface thereof.

There is a transfer drum for transferring the toner image formed on the photoreceptor drum onto a transfer paper, by bringing said transfer paper into contact with the photoreceptor drum. The transfer drum has a dielectric layer, a semiconductive layer and a conductive layer placed in this order from a side of a surface coming in contact with the transfer paper.

There is a power source section connected to the conductive layer, for application of a predetermined voltage to said conductive layer, and a ground roller provided on an upstream side of a transfer position on a surface of the dielectric layer with respect to a carrying direction of the transfer paper, said ground roller coming in contact with the surface of the dielectric layer through the transfer paper and generating a potential difference between the transfer paper and the conductive layer to which the voltage is applied.

An average distance between the semiconductive layer and the dielectric layer is controlled within a predetermined range so that charge is successively supplied (injected) from a ground roller side to a transfer drum side even after Paschen's discharge of from the transfer drum side to the ground roller side.

Preferably, in the foregoing image forming apparatus, the semiconductive layer is made of a foaming body having elastic property, and the average distance of between the semiconductive layer and the dielectric layer is set to be within the range of between 20 $\mu$m and 50 $\mu$m, in accordance with the foregoing arrangement.

The foregoing arrangement can have the same effect as the aforementioned ① and ② effects. In addition, according to the foregoing arrangement, ④ since the semiconductive layer is formed by a foaming body having elastic property, a rough surface caused by foams is formed on the semiconductive layer, and the average distance of between the semiconductive layer and the dielectric layer is easily controlled. By control of the size of an average micro-gap which is equalization of the whole micro-gap really existing between the semiconductive layer and the dielectric layer, i.e., control of the average distance of between the semiconductive layer and the dielectric layer to the range of between 20 $\mu$m and 50 $\mu$m, charge injection is carried out even after Paschen's discharge and charging potential on the transfer paper rises up. As a result, it is possible to supply a lot of charges on the transfer paper and to stably attract and hold the transfer paper onto the transfer drum.

Preferably, a rough is formed on a surface of the dielectric layer on a semiconductive layer side. When such rough is formed on the surface of the dielectric layer on the semiconductive layer side, ⑤ the average distance of between the semiconductive layer and the dielectric layer can be controlled not only by the rough caused by foams on the surface of the semiconductive layer, but also by the rough formed on the surface of the dielectric layer. Accordingly, it is possible to more freely design the size of the rough formed on the surface of the semiconductive layer, i.e., the diameter of foams of the foaming body used for the semiconductive layer, thus realizing easy control of the average distance of between the semiconductive layer and the dielectric layer.

As another preferred arrangement in accordance with the foregoing arrangement, it is preferable that (i) the semiconductive layer is a non-foaming body having elastic property, (ii) a rough is formed on at least one surface of the semiconductive layer and the dielectric layer facing each other and (iii) the average distance of between the semiconductive layer and the dielectric layer is set to be within the range of between 20 $\mu$m and 50 $\mu$m, in the foregoing image forming apparatus, The foregoing arrangement can have the same effect as the aforementioned ① and ② effects. In addition, according to the foregoing arrangement, ⑥ since the rough is formed on at least one surface of the semiconductive layer and the dielectric layer facing each other and the average distance of between the semiconductive layer and the dielectric layer is set to the range of between 20 $\mu$m and 50 $\mu$m, charge injection is carried out even after Paschen's discharge and charging potential on the transfer paper rises up, even when a non-foaming body having elastic property is used for the semiconductive layer. As a result, it is possible to supply a lot of charges on the transfer paper and to stably attract and hold the transfer paper onto the transfer drum.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, are not in any way intended to limit the scope of the claims of the present invention.

BRIEF DESCRIPTION OF THE DRAWINGS

FIG. 1(*b*) is a view schematically showing a micro-gap in the case where the micro-gap shown in FIG. 1(*a*) is equalized.

DESCRIPTION OF THE EMBODIMENTS

The following description deals with one embodiment of the present invention with reference to FIGS. 1 through 10.

Figure 2:
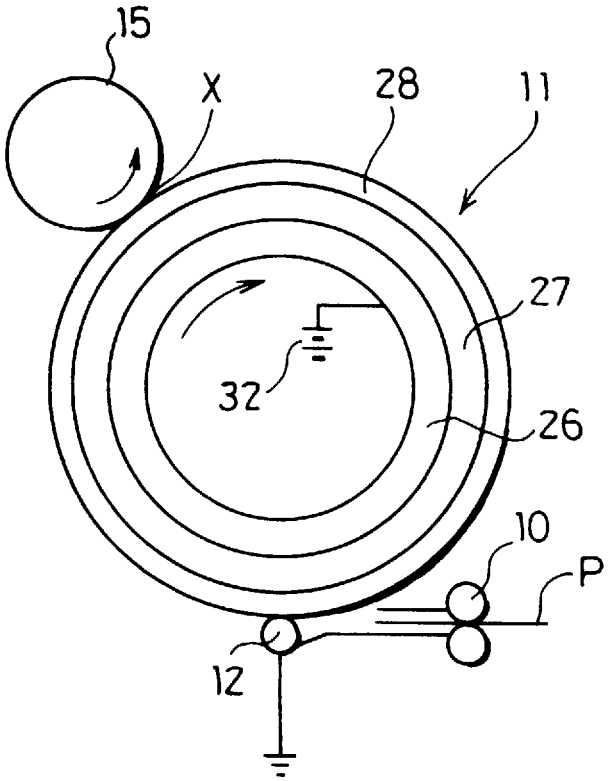
FIG. 2 is a schematic structural view showing a proximity of the transfer drum included in the image forming apparatus in accordance with one embodiment of the present invention.
Figure 3:
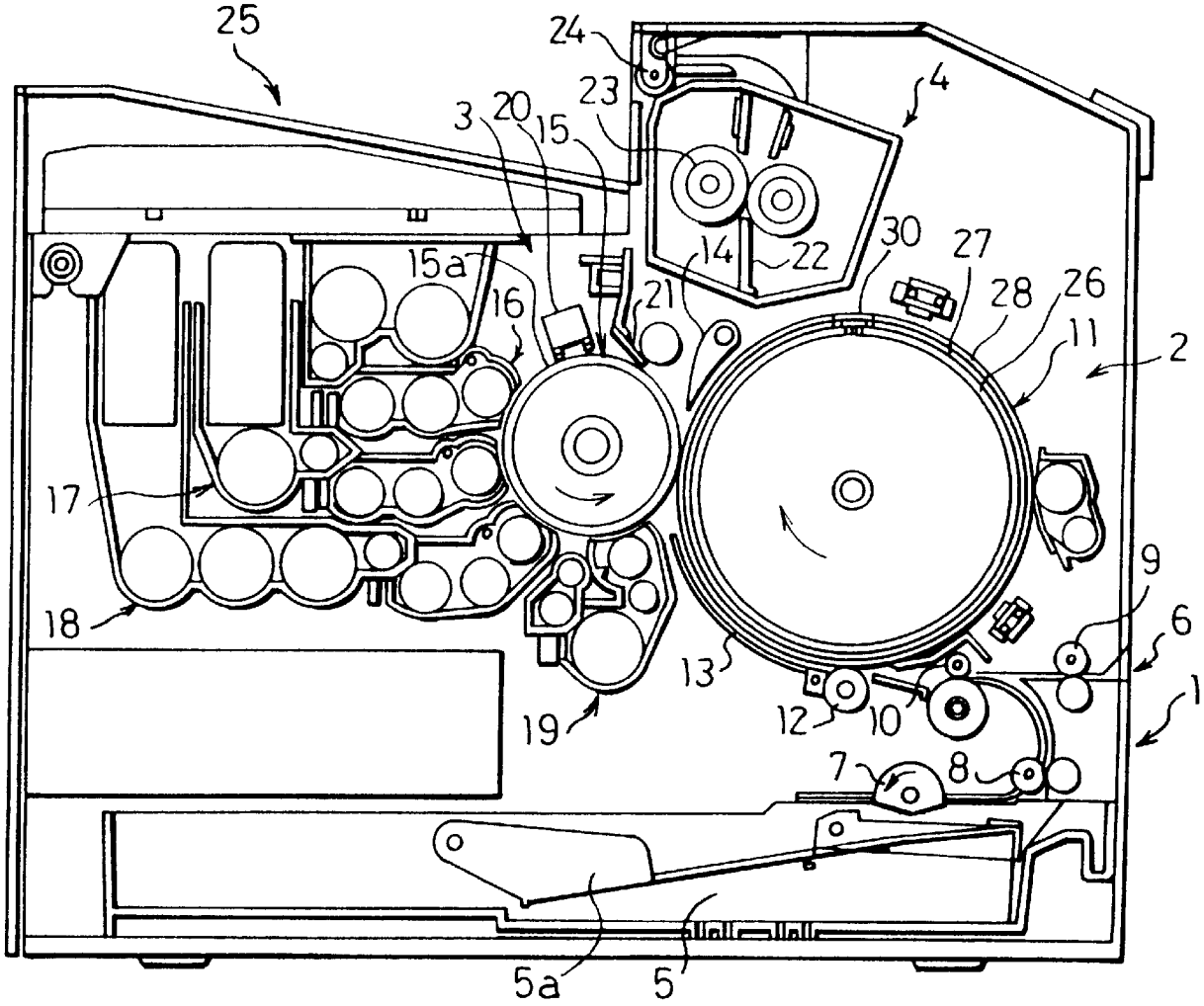
FIG. 3 is a schematic structural view showing the image forming apparatus comprising the transfer drum shown in FIG. 2.

An image forming apparatus of the present embodiment includes a paper feeding section 1, a transfer section 2, a development section 3 and a fixing section 4, as depicted in FIG. 3. The paper feeding section 1 stocks a transfer paper 'P' (see FIG. 2) and feeds(supplies) it. The transfer paper 'P' is a recording paper to form an image obtained by toner thereon. The transfer section 2 transfers a toner image onto the transfer paper 'P', and the development section 3 forms such toner image. The fixing section 4 fuses the toner image transferred to the transfer paper 'P' to fix the image.

There are provided a feed cassette 5, a manual paper feed section 6, a pick-up roller 7, a PF roller(pre-feed roller) 8, a manual paper feed-use roller 9 and a pre-curl roller(pre-curl means) 10 in the paper feeding section 1. The feed cassette 5 is disposed at the lowest position of a main body so that it can be freely attachable to and detachable from the main body, and stocks the transfer paper 'P' to feed it to the transfer section 2. The manual paper feed section 6 is disposed on the front side of the main body so that the transfer paper 'P' can be fed one by one from the front side through manual operation. The pick-up roller 7 feeds out the transfer paper 'P' one by one from the top portion of the feed cassette 5, and the PF roller 8 carries the transfer paper 'P' fed out by the pick-up roller 7. The manual paper feed-use roller 9 carries the transfer paper 'P' supplied from the manual paper feed section 6. The pre-curl roller 10 curls the transfer paper 'P' carried by the PF roller 8 or the manual paper feed-use roller 9.

The feed cassette 5 has a feeding-out member 5*a* forced in the upper direction by a spring or others. The transfer paper 'P' is piled up on this feeding-out member 5*a*. Accordingly, in the feed cassette 5, the top portion of the transfer paper 'P' comes into contact with the pick-up roller 7 and thus, in accordance with the rotation of the pick-up roller 7 in an narrowed direction, the transfer paper 'P' is fed out to the PF roller 8 one by one and carried to the pre-curl roller 10.

The transfer paper 'P' supplied from the manual paper feed section 6, is carried to the pre-curl roller 10 by the manual paper feed-use roller 9.

As described above, the pre-curl roller 10 curls the transfer paper 'P' carried thereto. This is because such curling enables the transfer paper 'P' to be easily attracted onto the surface of a transfer drum 11 in a cylindrical shape, which is provided in the transfer section 2.

Thus, the transfer section 2 has the transfer drum 11 as transfer means, and also has a ground roller(potential difference generating means) 12, a guide member 13 and a peeling-use claw 14 around the transfer drum 11. The ground roller 12 is a grounded electrode member and comes in contact with the transfer drum 11 through the transfer paper 'P'. The guide member 13 guides the transfer paper 'P' so as not to drop it down from the transfer drum 11. The peeling-use claw 14 compulsively peels off the transfer paper 'P' attracted onto the transfer drum 11. The peeling-use claw 14 is disposed so as to freely separate from the surface of the transfer drum 11 and come into contact with it.

The development section 3 has a photoreceptor drum 15 which is an image carrier coming in contact with the transfer drum 11 with pressure. The photoreceptor drum 15 is made of a grounded conductive aluminum tube 15*a* and an OPC film(not shown) is applied onto the surface of the photoreceptor drum 15.

Development containers 16, 17, 18 and 19 are provided radially around the photoreceptor drum 15. Development containers 16 through 19 store toners of yellow, magenta, cyan and black respectively. In addition, a charger 20 and a cleaning blade(as cleaning means) 21 are provided around the photoreceptor drum 15. The charger 20 charges the surface of the photoreceptor drum 15, and the cleaning blade 21 scrapes off a residual toner on the surface of the photoreceptor drum 15 and removes it out. As to every toner mentioned above, the toner image is formed on the photoreceptor drum 15: that is, as to every single color, charging, exposure, development and transfer is repeated with use of the photoreceptor drum 15. Accordingly, in the case of color transfer, the transfer paper 'P' electrostatically attracted onto the transfer drum 11 has a single color image through four rotations, at maximum, of the transfer drum 11, because a single color toner image is transferred onto the transfer paper 'P' every time the transfer drum 11 rotates.

The photoreceptor drum 15 and the transfer drum 11 are pressured and brought into contact with each other, so as to apply eight kilograms of pressure to a transfer portion, from a viewpoint of transfer efficiency and image quality.

A fixing roller 23 and a fixing-use guide 22 are provided in the fixing section 4. The fixing roller 23 fuses the toner image at a predetermined temperature and by a predetermined pressure, and fixes it on the transfer paper 'P'. The fixing-use guide 22 guides the transfer paper 'P' peeled from the transfer drum 11 by the peeling-use claw 14 to the fixing roller 23 after transfer of the toner image.

Furthermore, a discharging roller 24 is provided on a downstream side of the fixing section 4 with respect to the carrying direction of the transfer paper 'P'. The discharging roller 24 discharges the transfer paper 'P' after fusing from inside of the apparatus onto a discharge tray 25.

The following describes a detailed structure of the transfer drum 11.

As shown in FIG. 2, there are provided a conductive layer 26, a semiconductive layer 27 and a dielectric layer 28 in the transfer drum 11. The conductive layer 26 made of aluminum has a cylindrical shape and is used as base material. The semiconductive layer 27 is disposed on the upperface of the conductive layer 26, and made of a foaming body having elastic property. For example, urethane rubber (urethane foam) is used as a foaming body forming the semiconductive layer 27. The dielectric layer 28 is disposed on the upperface of the semiconductive layer 27. For example, PVDF(polyvinylidene fluoride) is used as the dielectric layer 28.

As voltage application means, a power source section 32 is connected with the conductive layer 26 so that stable voltage is maintained all over the conductive layer 26.

In order to provide a micro-gap between the semiconductive layer 27 and the dielectric layer 28, the following method is adopted as a method of providing every foregoing layer in the present invention: every foregoing layer is not glued by using an adhesive or others, but, for example, fixed by using a sheet pressing plate or others to press every layer and fix it. One example of such fixing method by use of a sheet pressing plate or others is to fix every layer by insertion of projections provided on such sheet pressing plate into a plurality of penetration holes which are provided on both ends of the semiconductive layer 27 and the dielectric layer 28 formed in a sheet shape and which penetrate the respective layers. Another example of such fixing method is to fix every layer by heat shrinking of the dielectric layer 28 formed in a cylindrical shape on the outer surface of the semiconductive layer 27 which is formed in a cylindrical shape and coats the conductive layer 26. Thus, the foregoing method of fixing every layer is not limited to specific ones, as long as such method prevents close adhesion between the semiconductive layer 27 and the dielectric layer 28 and it can maintain a predetermined gap amount.

Figure 4:
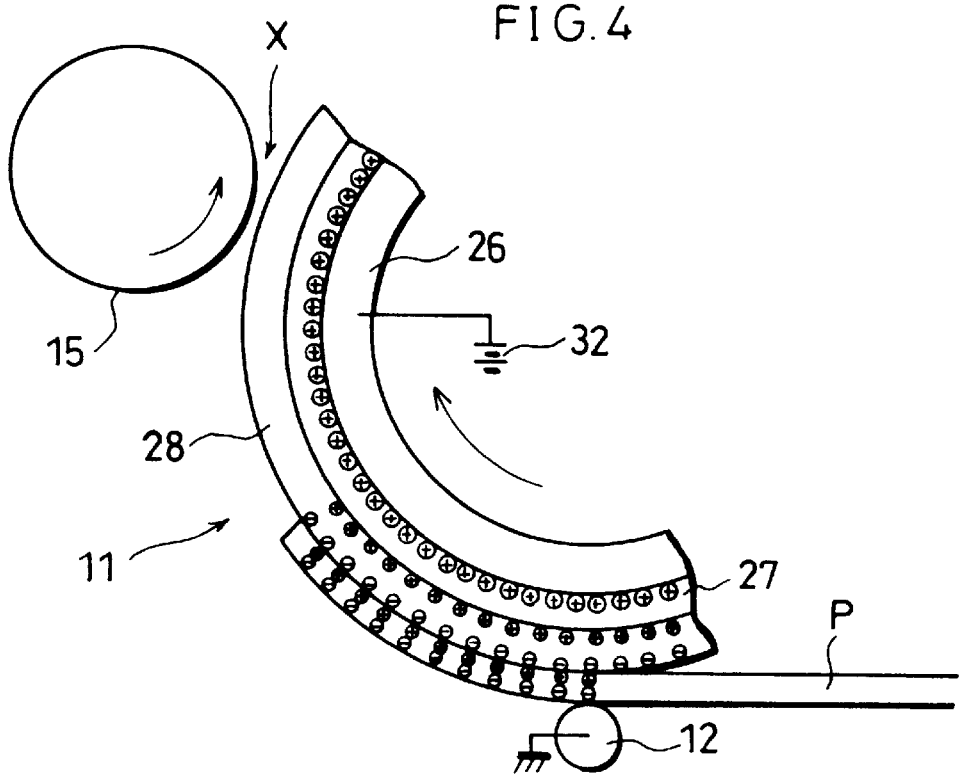
FIG. 4 is an explanatory view showing a charging state of the transfer drum shown in FIG. 2, and also showing an initial state where a transfer paper has been carried to the transfer drum.
Figure 5:
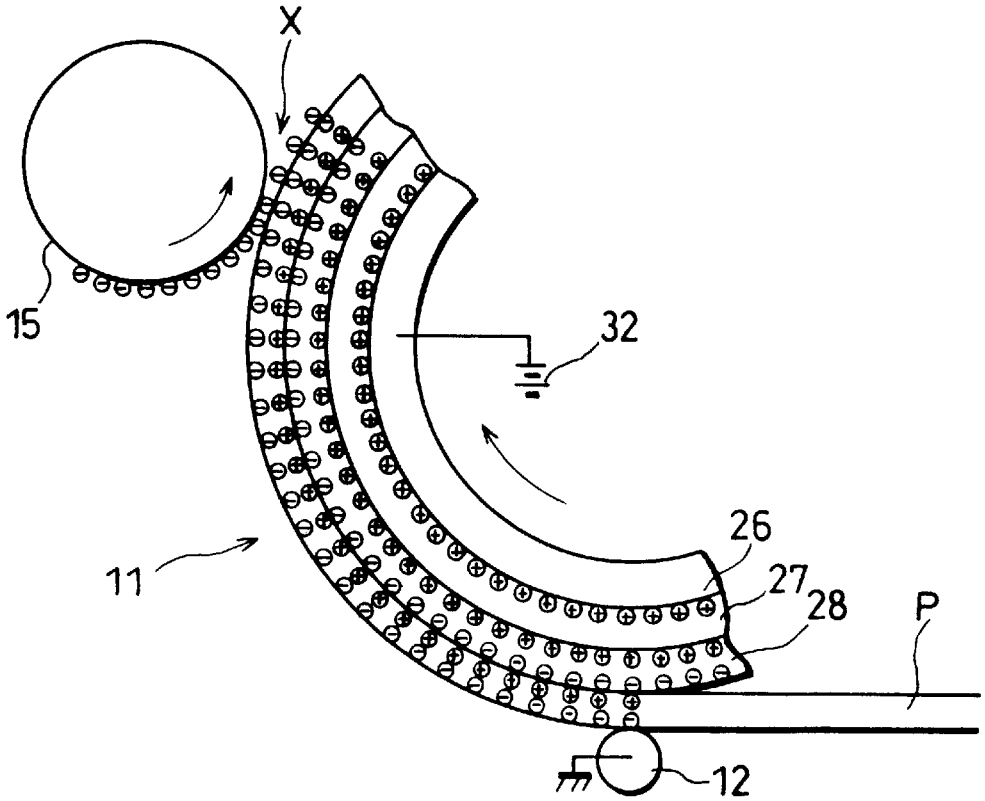
FIG. 5 is an explanatory view showing a charging state of the transfer drum shown in FIG. 2, and also showing a state where a transfer paper has been carried to a transfer position of the transfer drum.
Figure 6:
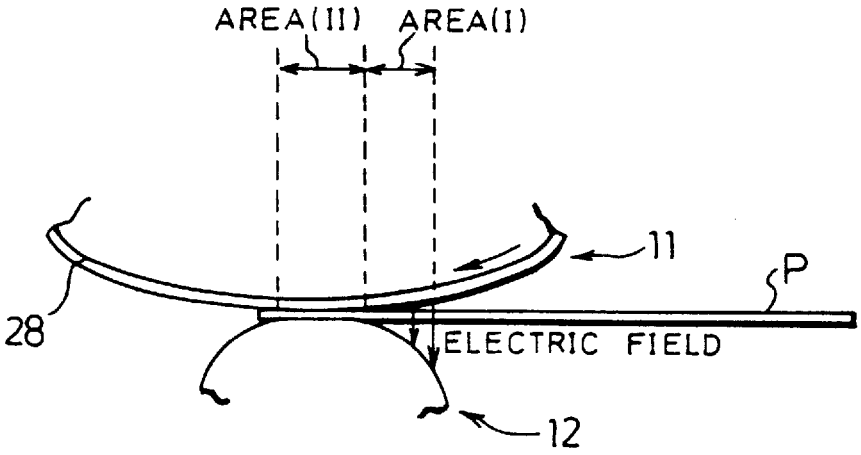
FIG. 6 is an explanatory view showing Paschen's discharge at a close part between the transfer drum shown in FIG. 2 and a ground roller.

The following explains attraction of the transfer paper 'P' and transfer of image onto the transfer paper 'P' by the transfer drum 11, with reference to FIGS. 4 through 6. Note that plus voltage is applied to the conductive layer 26 of the transfer drum 11 by the power source section 32.

First, attraction step of the transfer paper 'P' is described. In the image forming apparatus in accordance with the present invention, charge generating mechanism with use of the ground roller 12 for electrostatic attraction of the transfer paper 'P' is mainly composed of Paschen's discharge and charge injection; the transfer paper 'P' carried to the transfer drum 11 is pressed against the surface of the dielectric layer 28 by the ground roller 12. Charges accumulated in the semiconductive layer 27 are moved to the dielectric layer 28, and plus charges are induced on the surface of the dielectric layer 28 coming in contact with the semiconductive layer 27. Then, as shown in FIG. 6, as the distance between the ground roller 12 and the dielectric layer 28 of the transfer drum 11 is approaching and as the electric field strength brought to a close part (nip) between the ground roller 12 and the dielectric layer 28 is strengthened, air dielectric breakdown occurs and in the area (I), discharge of from the transfer drum 11 side to the ground roller 12 side, i.e. Paschen's discharge occurs.

Accordingly, minus charges are induced on the surface of the transfer drum 11 (i.e., the surface of the dielectric layer 28 coming in contact with the transfer paper 'P'), while plus charges are induced on the inside of the transfer paper 'P' (i.e., the surface side coming in contact with the dielectric layer 28).

After the end of such discharge, charge injection occurs at the nip between the ground roller 12 and the transfer drum 11 (i.e., the area (II) shown in FIG. 6), and minus charges are induced on the outside of the transfer paper 'P' (i.e., the surface side coming in contact with the ground roller 12).

Namely, Paschen's discharge is that, as the distance between the ground roller 12 and the dielectric layer 28 of the transfer drum 11 is approaching and as the electric field strength brought to the nip between the ground roller 12 and the dielectric layer 28 is strengthened, air dielectric breakdown occurs and in the area (I) shown in FIG. 6, discharge of from the transfer drum 11 side to the ground roller 12 side occurs.

Charge injection shows that, after the end of the discharge, charges are injected from the ground roller 12 side to the transfer drum 11 side, at the nip between the ground roller 12 and the transfer drum 11 (i.e., the area (II) ).

Thus, plus charges are induced on the inside of the transfer paper 'P' by the Paschen's discharge and the charge injection following the Paschen's discharge. The transfer paper 'P' is electrostatically attracted onto the transfer drum 11 by the attractive force between (i) the charge due to plus voltage applied by the power source section 32 and (ii) the minus charge on the outside of the transfer paper 'P'. This attractive force can stably attract the transfer paper 'P' onto the transfer drum 11 and never becomes uneven as long as the application voltage is stable. The surface of the transfer drum 11 is uniformly charged through the rotation of the ground roller 12 and the transfer drum 11.

The transfer paper 'P' attracted onto the transfer drum 11 is carried to the transfer point 'X' of the toner image, according to the rotation of the transfer drum 11 in the narrowed direction.

Next, transfer step of the transfer paper 'P' is described. As shown in FIG. 5, toners having minus charges are attracted onto the surface of the photoreceptor drum 15. Accordingly, it is assumed that repulsive force occurs between the transfer paper 'P' and the toners on the photoreceptor drum 15 if the transfer paper 'P' of which the outer surface is minus-charged is carried to the transfer point 'X'. However, attractive force to compensate the repulsive force occurring between the transfer paper 'P' and the toners on the photoreceptor drum 15 is generated by the power source section 32. As a result, the toner image is transferred onto the transfer paper 'P'.

Thus, unlike conventional arrangements, the present invention does not use air discharge for attraction of the transfer paper 'P' and transfer onto said transfer paper 'P'. Instead, in the present invention, attraction of the transfer paper 'P' and transfer onto said transfer paper 'P' is carried out through charge injection and local discharge at the nip between the dielectric layer 28 of the transfer drum 11 and the ground roller 12. This allows low voltage to be sufficient for voltage to be applied to the conductive layer 26, and also allows easy voltage control. Accordingly, the foregoing image forming apparatus can stably charge (electrify) the surface of the transfer drum 11 and can stably attract the transfer paper 'P' and transfer onto said transfer paper 'P', as compared with charge(electrification) due to induction of charge to the surface of the transfer drum by air discharge as in the conventional arrangements. In addition, the foregoing arrangement can improve transfer efficiency and image quality, since it is possible to reduce irregularity of voltage brought to the transfer drum 11. Occurrence of ozone is also diminished.

The Inventors have also found as the result of diverse investigations that electrostatic attraction strength of the transfer paper 'P' can be improved regardless of the application voltage or the thickness of the dielectric layer 28, etc., by means of specification of the size of the micro-gap between the dielectric layer 28 and the semiconductive layer 27.

The following explains the relation between (i) the size of the micro-gap between the dielectric layer 28 and the semiconductive layer 27 and (ii) charging potential and electrostatic attraction strength of the transfer paper 'P', with reference to FIGS. 1 and 7 through 10.

Figure 10:
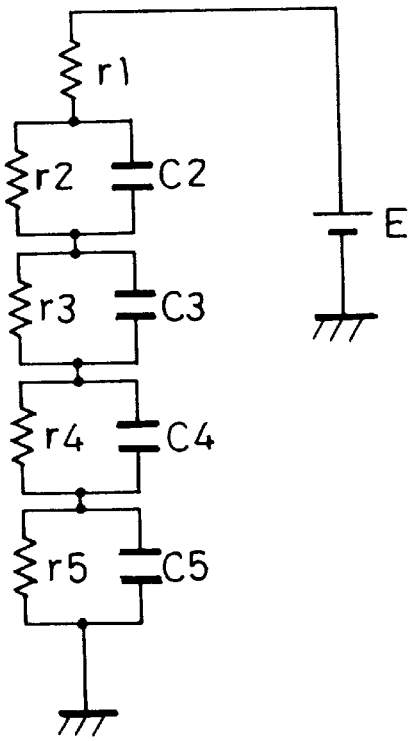
FIG. 10 is a circuit diagram showing an equivalent circuit of charge injection mechanism between the transfer drum and a ground roller shown in FIG. 2.
Figure 11:
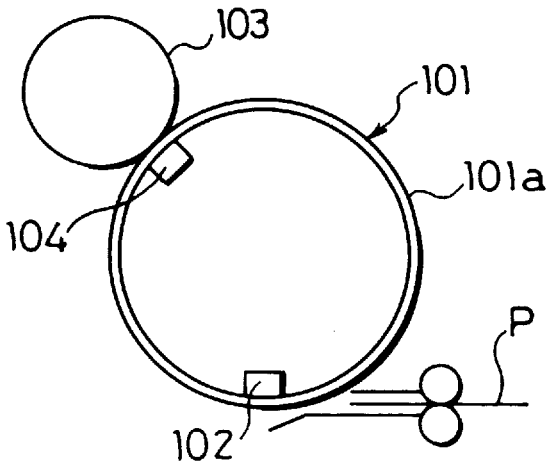
FIG. 11 PRIOR ART
FIG. 11 is a schematic structural view of one conventional image forming apparatus.
Figure 12:
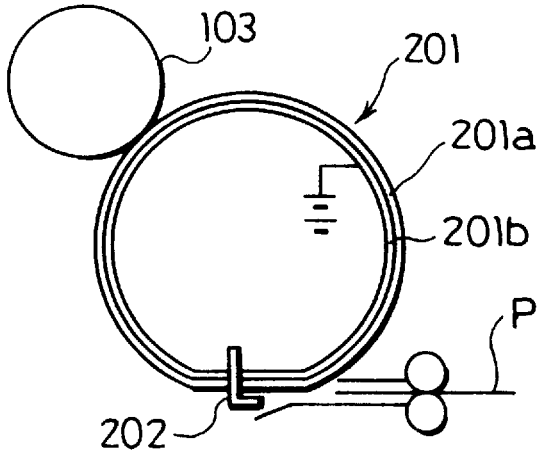
FIG. 12 PRIOR ART
FIG. 12 is a schematic structural view of another conventional image forming apparatus.

FIG. 10 shows an equivalent circuit illustrating a mechanism of the charge injection following the Paschen's discharge. In the foregoing equivalent circuit, the charge injection corresponds to accumulation of charges on capacitors through electric current which flows the circuit. That is, 'E' represents the application voltage applied to the conductive layer 26 by the power source section 32, 'r1' represents the resistance of the semiconductive layer 27, 'r2' represents the contact resistance of between the semiconductive layer 27 and the dielectric layer 28, 'r3' represents the resistance of the dielectric layer 28, 'r4' represents the resistance of the transfer paper 'P' and 'r5' represents the contact resistance of between the transfer paper 'P' and the ground roller 12. 'c2' represents the capacitance of between the semiconductive layer 27 and the dielectric layer 28, 'C3' represents the capacitance of the dielectric layer 28, 'C4' represents the capacitance of the transfer paper 'P' and 'C5' represents the capacitance of the micro-gap between the transfer paper 'P' and the ground roller 12.

Here, in order to obtain the charge amount (potential) accumulated on 'C2', the potential difference across 'C2' in the foregoing equivalent circuit is solved, provided that the charge amount (potential) charged by the Paschen's discharge is an initial potential, and the charging potential including consideration of both the Paschen's discharge and the charge injection is obtained. The analysis formula of the final charging potential (V2) of the transfer paper 'P' obtained in this manner is as follows:

$$V2=A\times(b\times e^{B}-c\times e^{C})$$

(A, B, C, b and c in this formula represent constants depending on the circuit.)

Thus, the charge (potential) accumulated onto the surface of the transfer paper 'P' on the transfer drum 11 side, shows the reverse polarity, as compared with the voltage applied to the conductive layer 26. As a result, attractive force arises between the transfer paper 'P' and the conductive layer 26, and the transfer paper 'P' is electrostatically attracted onto the transfer drum 11. That is, it is considered that the higher is the charging potential of the transfer paper 'P', the greater is the electrostatic attraction force onto the transfer drum 11.

Accordingly, a variety of modifications were made about (i) the size of the micro-gap between the dielectric layer 28 and the semiconductive layer 27, i.e., the average distance between the dielectric layer 28 and the semiconductive layer 27, and (ii) the application voltage. Then, the relation between the nip time (t) and the charging potential of the transfer paper 'P' was graphed: the nip time is a time required for any point on the transfer paper 'P' to pass through the nip between the transfer drum 11 and the ground roller 12, while the charging potential of the transfer paper 'P' is a value which is obtained by asking for the amount of injected charges at every nip time based on the foregoing analysis formula. Some examples of such graphs are shown in FIGS. 7 through 9.

Figure 7:
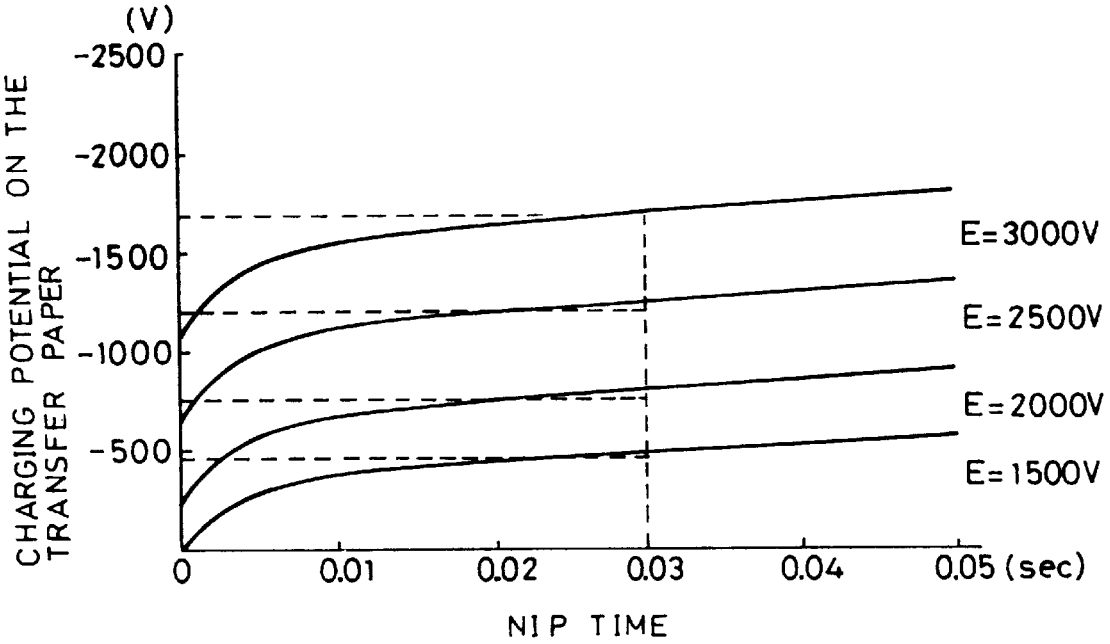
FIG. 7 is a graph showing a relation between charging potential on the transfer paper and a nip time.

FIG. 7 is a graph showing the relation between the nip time (t) and the charging potential of the transfer paper 'P' for application of voltages (1500 V, 2000 V, 2500 V and 3000 V respectively) to the conductive layer 26, provided that the micro-gap between the dielectric layer 28 and the semiconductive layer 27 is set to be 40 $\mu$m. In this graph, the horizontal axis represents the nip time, while the vertical axis represents the charging potential on the transfer paper 'P'. The intercept of the vertical axis represents an initial charging potential due to Paschen's discharge. When the nip time is for example set to 0.03 seconds, the charging potential on the transfer paper 'P' is regarded as value shown by every intersection between the broken line and the vertical axis in FIG. 7.

FIG. 7 shows that, when the micro-gap between the dielectric layer 28 and the semiconductive layer 27 is set to 40 $\mu$m, the charging potential rises up through more charge injection after Paschen's discharge (t=0) regardless of the application voltage and thus, electrostatic attraction force of the transfer paper 'P'to the transfer drum 11 becomes great.

Figure 8:
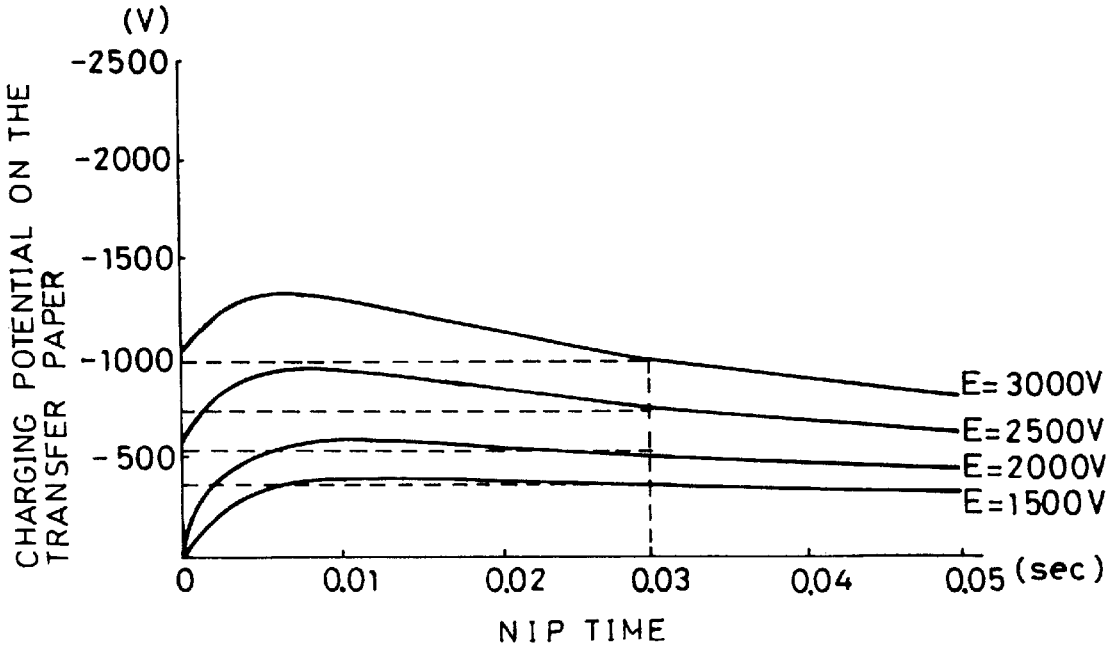
FIG. 8 is a graph showing a relation between charging potential on the transfer paper and a nip time, under a condition different from that of FIG. 7.
Figure 9:
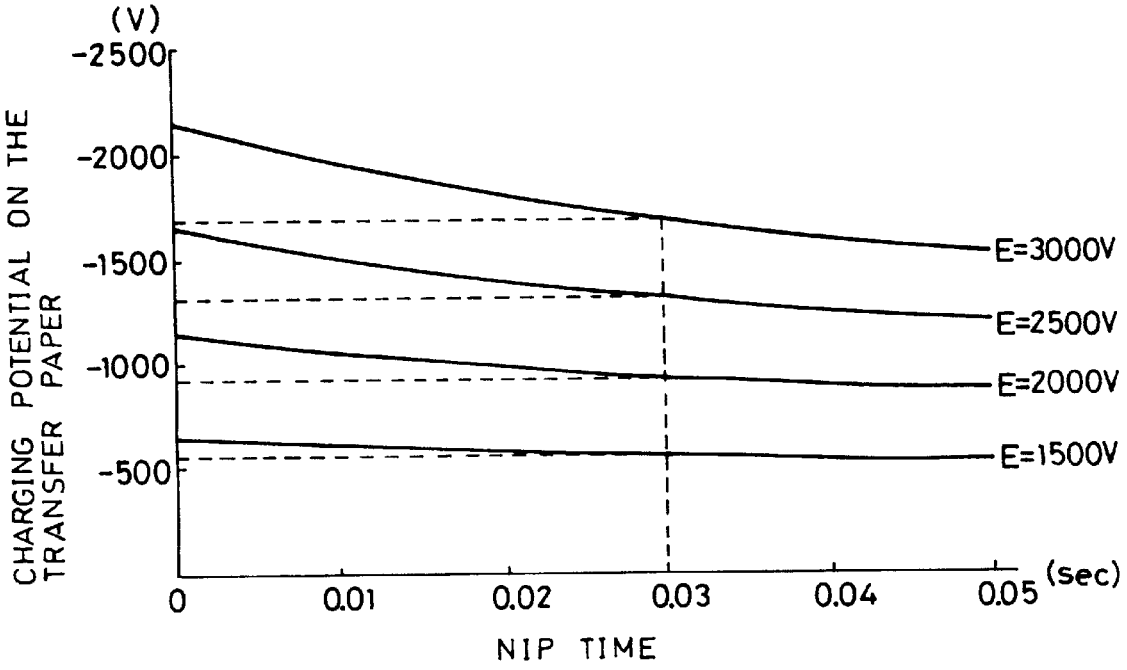
FIG. 9 is a graph showing a relation between charging potential on the transfer paper and a nip time, under another condition different from that of FIG. 7.

Likewise, FIG. 8 is a graph showing the relation between the nip time and the charging potential on the transfer paper 'P' under the condition that the micro-gap between the dielectric layer 28 and the semiconductive layer 27 is set to 70 μm, while FIG. 9 is a graph showing the relation between the nip time and the charging potential on the transfer paper 'P' under the condition that the micro-gap is set to 10 μm.

As shown in FIG. 8, when the micro-gap between the dielectric layer 28 and the semiconductive layer 27 is set to 70μm , the charging potential on the transfer paper 'P' temporarily rises up at an initial stage of the charge injection (around t=0.005 through 0.01) regardless of the application voltage, but it thereafter starts to decrease. For this reason, in the case of some application voltage, for example, the charging potential after t=0.03 seconds becomes smaller than the initial charging potential (t=0) and thus, electrostatic attraction of the transfer paper 'P' to the transfer drum 11 has drawback in the case where the micro-gap is set to 70 μm.

As shown in FIG. 9, when the micro-gap between the dielectric layer 28 and the semiconductive layer 27 is set to 10 μm, no charge injection is carried out. The charging potential on the transfer paper 'P' therefore gets smaller than the initial charging potential (t=0) of the charge injection regardless of the application voltage. Accordingly, electrostatic attraction of the transfer paper 'P' to the transfer drum 11 has drawback in the case where the micro-gap is set to 10 μm.

Furthermore, the following facts were acknowledged as a result of investigations concerning the relation between the nip time and the charging potential on the transfer paper 'P' with various modifications of the size of the micro-gap between the dielectric layer 28 and the semiconductive layer 27. That is, when the micro-gap is within the range of 20 μm through 50 μm, the same tendency as that shown in FIG. 7 was observed. In other words, when the micro-gap is within the range of 20 μm through 50μm the charging potential on the transfer paper 'P' rises up through more charge injection after the Paschen's discharge (t=0) regardless of the application voltage and thus, electrostatic attraction force of the transfer paper 'P' to the transfer drum 11 becomes great. Accordingly, it is possible to supply a lot of charges onto the transfer paper 'P' by setting the micro-gap to be within the range of 20 μm through 50 μm. The transfer paper 'P' can be therefore stably electrostatically-attracted onto the transfer drum 11.

When the micro-gap is set to be greater than 50 μm, the same tendency as that shown in FIG. 8 was observed. In other words, when the micro-gap is set to be greater than 50 μm, in the case of some application voltage, the charging potential becomes smaller than the initial charging potential of the charge injection as the nip time becomes greater. Thus, electrostatic attraction of the transfer paper 'P' to the transfer drum 11 has disadvantage in the case where the micro-gap is set to be greater than 50 μm.

When the micro-gap is set to be smaller than 20 μm, the same tendency as that shown in FIG. 9 was observed. In other words, when the micro-gap is set to be smaller than 20 μm, no charge injection is carried out, and the charging potential on the transfer paper 'P' gets smaller than the initial charging potential of the charge injection as the nip time becomes greater. For this reason, electrostatic attraction of the transfer paper 'P' to the transfer drum 11 has disadvantage in the case where the micro-gap is set to be smaller than 20 μm.

As described above, it is preferable that the average distance of between the semiconductive layer 27 and the dielectric layer 28 is controlled within a predetermined range so that the charge injection (supply of charge) from the ground roller 12 side to the transfer drum 11 side may be successively carried out even after the Paschen's discharge of from the transfer drum 11 side to the ground roller 12 side. Theoretically it is most appropriate to set the micro-gap between the dielectric layer 28 and the semiconductive layer 27 to be within the range of 20 μm through 50 μm.

Moreover, the foregoing conclusion was supported through the following experiments. We evaluated electrostatic attraction force of the transfer paper 'P' to the transfer drum 11 with a variety of modifications of the size of the micro-gap between the dielectric layer 28 and the semiconductive layer 27. The result of these experiments is shown in TABLE 1. Note that, with respect to the effect of the electrostatic attraction force, its evaluation depends on whether or not the transfer paper 'P' was stably electrostatically-attracted onto the transfer drum 11 during the four rotations of the transfer drum 11.

TABLE 1

| MICRO-GAP (μm) BETWEEN DIELECTRIC LAYER AND SEMICONDUCTIVE LAYER | ELECTROSTATIC ATTRACTION FORCE |
|---|---|
| LESS THAN 10 | X |
| 10 | X |
| 20 | ○ |
| 30 | ○ |
| 40 | ○ |
| 50 | ○ |
| 60 | X |
| NOT LESS THAN 60 | X |

○; VERY EFFECTIVE
X; NOT EFFECTIVE

As is evident from the result shown in TABLE 1, it was found that it is necessary for the micro-gap to be set within the range of between 20 μm and 50 μm in order that the transfer paper 'P' can be stably electrostatically-attracted onto the transfer drum 11 during the four rotations of the transfer drum 11. It was also found that, when the micro-gap is either less than 20 μm or more than 50 μm, the transfer paper 'P' is peeled away from the transfer drum 11 during the four rotations of the transfer drum 11 and thus, it is difficult to realize a stable electrostatic attraction of the transfer paper 'P' onto the transfer drum 11.

Accordingly, judging from the results of TABLE 1 and graphs shown in FIGS. 7 through 9, when the micro-gap between the dielectric layer 28 and the semiconductive layer 27 is set within the range of between 20 μm and 50 μm, it is possible to achieve a stable electrostatic attraction of the transfer paper 'P' onto the transfer drum 11 during the four rotations of the transfer drum 11.

On the other hand, the foregoing electrostatic attraction force is also influenced by the diameter of foams in the semiconductive layer 27. TABLE 2shows the relation between the diameter of foams in the semiconductive layer 27 and the electrostatic attraction force of the transfer paper 'P'. Note that the effect of the electrostatic attraction force is evaluated by whether or not the transfer paper 'P' was stably electrostatically-attracted onto the transfer drum 11 during the four rotations of the transfer drum 11.

TABLE 2

| DIAMETER OF FOAM (μm) | ELECTROSTATIC ATTRACTION FORCE |
|---|---|
| LESS THAN 100 | X |
| 100 | X |
| 200 | ○ |
| 300 | ○ |

TABLE 2-continued

| DIAMETER OF FOAM (μm) | ELECTROSTATIC ATTRACTION FORCE |
|---|---|
| 400 | ○ |
| 500 | X |
| NOT LESS THAN 600 | X |

○; VERY EFFECTIVE
X; NOT EFFECTIVE

As evident from the result shown in TABLE 2 , it was found that it is optimal for the diameter of the foam in the semiconductive layer 27 to be within the range of between 200 μm and 400 μm. If the diameter of the foam is less than 200 μm, the rough caused by the foams (i.e., the irregularity formed on the surface of the semiconductive layer 27) gets smaller. For this reason, the micro-gap generated between the dielectric layer 28 and the semiconductive layer 27 gets too smaller (less than 20 μm). Accordingly, its setting has disadvantages about the electrostatic attraction force of the transfer paper 'P' onto the transfer drum 11 and thus its setting is not preferable. On the other hand, if the diameter of the foam is greater than 400 μm, the rough caused by the foams sufficiently gets greater from a viewpoint of the charge injection after the Paschen's discharge. For this reason, the micro-gap generated between the dielectric layer 28 and the semiconductive layer 27 also sufficiently gets greater. However, since the diameter of the foam is too great, the hardness of the semiconductive layer 27 extremely gets low. Accordingly, the curl in the opposite direction (i.e., the curl not along the transfer drum 11) may occur for the transfer paper 'P' while the transfer paper 'P' comes in contact with the ground roller 12. Thus, its setting has disadvantages about the electrostatic attraction force of the transfer paper 'P' and its setting is not preferable. Note that the hardness of the semiconductive layer 27 is preferably within the range of between 25 and 50 at Askar C.

As described above, it is preferable that the diameter of the foam in the semiconductive layer 27 is controlled within a predetermined range so that the charge injection from the ground roller 12 side to the transfer drum 11 side may be successively carried out even after the Paschen's discharge of from the transfer drum 11 side to the ground roller 12 side. To be more specific, it is optimal for the diameter of the foam to be within the range of between 200 μm and 400 μm. By setting the diameter of the foam within such range, it is possible to supply a lot of charges onto the transfer paper 'P'. In addition, the curl in the opposite direction to the transfer drum 11 is not brought to the transfer paper 'P'. As a result, the transfer paper 'P' can be stably electrostatically-attracted and held onto the transfer drum 11.

Also in the case where non-foaming body is used for the semiconductive layer 27, the same effect as the foregoing one can be obtained by (i) providing a rough (irregularity) on the surface of the semiconductive layer 27 on the side coming in contact with the dielectric layer 28, and (ii) controlling the micro-gap within the range of between 20 μm and 50 μm, by means of such rough. The foregoing non-foaming body is not limited to a specific one as long as it has elastic property. For example, silicon, etc., can be used as this kind of non-foaming body.

Moreover, the same effect can be also obtained by providing a rough on the surface of the dielectric layer 28 on the side coming in contact with the semiconductive layer 27. That is, it is possible to easily provide the micro-gap between the semiconductive layer 27 and the dielectric layer 28, if a rough (irregularity) is formed on at least one surface of the surfaces facing each other of the dielectric layer 28 and the semiconductive layer 27. In addition, by controlling the average distance of the micro-gap between the semiconductive layer 27 and the dielectric layer 28 within the range of between 20 μm and 50 μm, it is possible to supply a lot of charges onto the transfer paper 'P'. As a result, the transfer paper 'P' can be stably electrostatically-attracted and held onto the transfer drum 11.

When such rough is formed respectively on the both surfaces facing each other of the dielectric layer 28 and the semiconductive layer 27, for example, the average distance of the micro-gap between the semiconductive layer 27 and the dielectric layer 28 can be controlled not only by the rough formed on the surface of the semiconductive layer 27, but also by the rough formed on the surface of the dielectric layer 28. For this reason, it is possible to (i) more freely design the size of the rough formed on the surface of the semiconductive layer 27, i.e., the size of the diameter of the foam of the foaming body used for the semiconductive layer 27, and also to (ii) easily control the average distance of the micro-gap.

The foregoing rough can be easily formed by carrying out, for example, embossing on the semiconductive layer 27 or the dielectric layer 28. By such an embossing, it is possible to easily and low-costly form the rough of desirable size or height, without any complicated metal mold or high-technique. However, the method of forming such rough is not limited to the foregoing one, and another method, for example, the method using a metal mold, etc., may be also adopted.

Figure 1:
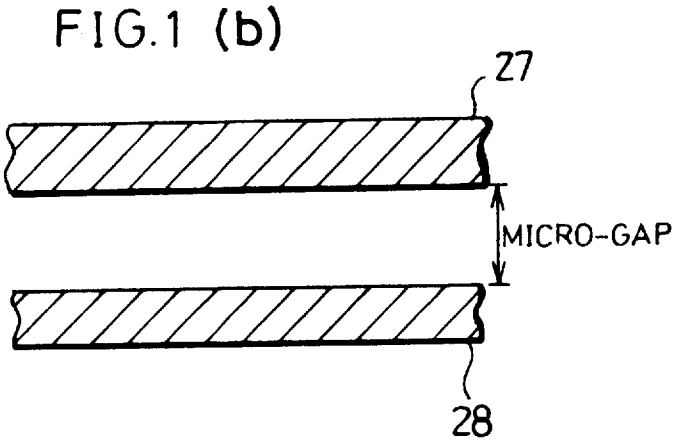
FIG. 1(*a*) is a view schematically showing a micro-gap really existing between a semiconductive layer and a dielectric layer of a transfer drum included in an image forming apparatus in accordance with one embodiment of the present invention.
Figure 1:
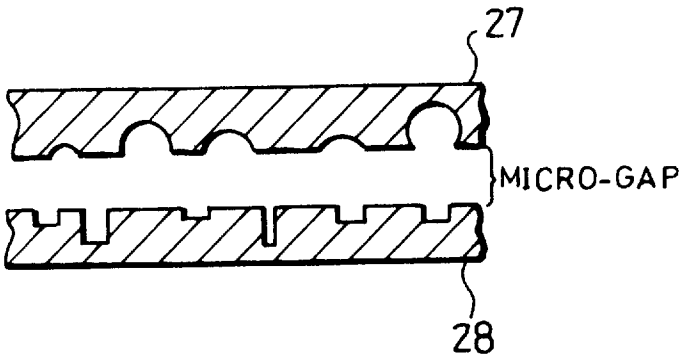

The following describes about the method of calculation of the micro-gap between the semiconductive layer 27 and the dielectric layer 28, with reference to FIGS. 1(*a*) and 1(*b*). Note that the following explanation is about one example of the calculation method of the micro-gap in the case where a foaming body having elastic property is used for the semiconductive layer 27 and an embossing is carried out against the dielectric layer 28 on the side coming in contact with the semiconductive layer 27.

FIG. 1(*a*) is a view (model view) schematically showing the micro-gap really existing between the semiconductive layer 27 and the dielectric layer 28. As shown in FIG. 1(*a*), in the micro-gap really existing between the semiconductive layer 27 and the dielectric layer 28, there occurs partially difference in its size, because of the rough on the both surfaces of the semiconductive layer 27 and the dielectric layer 28. As the calculation method of such micro-gap, the following step is adopted; that is, as shown in FIG. 1(*b*), equalization is carried out for equalizing the whole micro-gap really existing between the semiconductive layer 27 and the dielectric layer 28 including (i) the micro-gap at the rough part due to the foam of the surface of the semiconductive layer 27 and (ii) the micro-gap at the rough part formed on the surface of the dielectric layer 28. Next, the micro-gap is calculated by measurement of the size of the micro-gap equalized by the foregoing equalization, i.e., the average distance between the semiconductive layer 27 and the dielectric layer 28. Likewise, equalization can be also carried out for calculation of the micro-gap in the case where a non-foaming body is used for the semiconductive layer 27 and a rough is formed on the semiconductive layer 27 on the side coming in contact with the dielectric layer 28, and an embossing, etc., is not carried out against the dielectric layer 28. Namely, the size of the micro-gap in the description of the present embodiment means the size of the foregoing average micro-gap.

Preferably, the volume resistivity of the semiconductive layer 27 is within the range of between $10^8$ Ω·cm and $10^{11}$ Ω·cm. When the volume resistivity of the semiconductive layer 27 is smaller than $10^8$ Ω·cm, there flows too much of electric current between the photoreceptor drum 15 and the transfer drum 11 at the time of toner transfer, because the resistance value is too low. For this reason, in the current between the photoreceptor drum 15 and the transfer drum 11, the current component flowing due to the circuit contact which conforms to the Ohm's law has priority over the current component flowing due to the movement of the toner from the photoreceptor drum 15 to the transfer paper 'P'. Accordingly, it is not preferable that the volume resistivity of the semiconductive layer 27 is smaller than $10^8$ Ω·cm, because the movement of the toner to the transfer paper 'P' is prevented and, as a result, the back transfer occurs.

On the other hand, if the volume resistivity of the semiconductive layer 27 is greater than $10^{11}$ Ω·cm, the resistance value is too high. Therefore, both of (i) the current component flowing due to the circuit contact which conforms to the Ohm's law and (ii) the current component flowing due to the movement of the toner from the photoreceptor drum 15 to the transfer paper 'P' hardly flow between the photoreceptor drum 15 and the transfer drum 11. Accordingly, it is not preferable that the volume resistivity of the semiconductive layer 27 is greater than $10^{11}$ Ω·cm, because the movement of the toner to the transfer paper 'P' is prevented and unsatisfactory transfer occurs.

Therefore, when the volume resistivity of the semiconductive layer 27 is within the range of between $10^8$ Ω·cm and $10^{11}$ Ω·cm, it is possible to realize an efficient transfer without any occurrence of the back transfer or unsatisfactory transfer. More preferably, the volume resistivity of the semiconductive layer 27 is within the range of between $10^9$ Ω·cm and $10^{10}$ Ω·cm.

Furthermore, it is preferable that the volume resistivity of the dielectric layer 28 is within the range of between $10^9$ Ω·cm and $10^{15}$ Ω·cm. When the volume resistivity of the dielectric layer 28 is smaller than $10^9$ Ω·cm, there flows too much of electric current between the photoreceptor drum 15 and the transfer drum 11 at the time of toner transfer, because the resistance value is too low. For this reason, in the current between the photoreceptor drum 15 and the transfer drum 11, the current component flowing due to the circuit contact which conforms to the Ohm's law has priority over the current component flowing due to the movement of the toner from the photoreceptor drum 15 to the transfer paper 'P'. Accordingly, it is not preferable that the volume resistivity of the the dielectric layer 28 is smaller than $10^9$Ω·cm, because the movement of the toner to the transfer paper 'P' is prevented and, as a result, the back transfer occurs.

On the other hand, if the volume resistivity of the dielectric layer 28 is greater than $10^{15}$ Ω·cm, the resistance value is too high. Therefore, both of (i) the current component flowing due to the circuit contact which conforms to the Ohm's law and (ii) the current component flowing due to the movement of the toner from the photoreceptor drum 15 to the transfer paper 'P' hardly flow between the photoreceptor drum 15 and the transfer drum 11. Accordingly, it is not preferable that the volume resistivity of the dielectric layer 28 is greater than $10^{15}$ Ω·cm, because the movement of the toner to the transfer paper 'P' is prevented and unsatisfactory transfer occurs.

Therefore, when the volume resistivity of the dielectric layer 28 is within the range of between $10^9$ Ω·cm and $10^{1\ 5}$ Ω·cm, it is possible to realize an efficient transfer without any occurrence of the back transfer or unsatisfactory transfer. More preferably, the volume resistivity of the dielectric layer 28 is within the range of between $10^{11}$ Ω·cm and $10^{13}$ Ω·cm.

Referring now to FIGS. 3 through 5, the following description will discuss an image forming process in the image forming apparatus having the foregoing structure.

First, as illustrated in FIG. 3, when automatically feeding the transfer paper 'P' (see FIG. 4), the transfer paper 'P' is fed, sheet by sheet, to the PF roller 8 from the feed cassette 5 disposed on the lowest level of the main body. The transfer paper 'P' is successively fed from the topmost portion by the pick-up roller 7. The transfer paper 'P' which has passed through the PF roller 8 is curled along the surface shape of the transfer drum 11 by the pre-curl roller 10.

On the other hand, when manually feeding the transfer paper 'P', the transfer paper 'P' is fed, sheet by sheet, to the pre-curl roller 10 from the manual paper feed section 6 located on the front side of the main body by the manual paper feed-use roller 9. Then, the transfer paper 'P' is curled along the surface shape of the transfer drum 11 by the pre-curl roller 10.

Next, as illustrated in FIG. 4, the transfer paper 'P' which has been curled by the pre-curl roller 10 is transported to the section between the transfer drum 11 and the ground roller 12. Then, the Paschen's discharge of from the transfer drum 11 side to the ground roller 12 side occurs. After the end of the discharge, charges are injected at the nip between the ground roller 12 and the transfer drum 11. As a result, charges are induced on the surface of the transfer paper 'P', and the transfer paper 'P' is electrostatically attracted onto the surface of the transfer drum 11.

Thereafter, as illustrated in FIG. 5, the transfer paper 'P' attracted onto the transfer drum 11 is transported to the transfer point 'X' where the transfer drum 11 and the photoreceptor drum 15 are brought into contact with each other with pressure. Then, the toner image is transferred to the transfer paper 'P' due to the potential difference between the charge of the toner formed on the photoreceptor drum 15 and the charge caused by the voltage applied to the conductive layer 26 by the power source section 32.

At this time, on the photoreceptor drum 15, a series of charging, exposure, development and transfer operations are performed for each color. The transfer paper 'P' attracted onto the transfer drum 11 rotates in accordance with the rotation of the transfer drum 11. A one-color image is transferred onto the transfer paper 'P' with one rotation of the transfer drum 11, and a full-color image is obtained with its four rotations at maximum. However, in order to obtain a black-and-white image or a mono-color image, it is sufficient with one rotation of the transfer drum 11.

Moreover, when all of the toner images have been transferred to the transfer paper 'P', the transfer paper 'P' is forced to separate from the surface of the transfer drum 11 by the peeling-use claw 14 which is movable to touch or separate from the circumference of the transfer drum 11, and is guided to the fixing-use guide 22.

The transfer paper 'P' is then guided to the fixing roller 23 by the fixing-use guide 22, and the toner image on the transfer paper 'P' is fused and fixed onto the transfer paper 'P' by the heat and pressure of the fixing roller 23.

The transfer paper 'P' carrying the image fixed thereon is discharged onto the discharge tray 25 by the discharging roller 24.

As described above, the transfer drum 11 includes, from inside toward outside, the conductive layer 26 made of aluminum, the semiconductive layer 27 made of a foaming body having elastic property such as urethane rubber, and the dielectric layer 28 made of PVDF. With this configuration, when voltage is applied to the conductive layer 26, charges are successively induced on the conductive layer 26 and the semiconductive layer 27, and accumulated on the semiconductive layer 27. When the transfer paper 'P' is transported to the section between the transfer drum 11 and the ground roller 12, the Paschen's discharge of from the transfer drum 11 side to the ground roller 12 side occurs, and after the end of the discharge, charges are injected from the ground roller 12 side to the transfer drum 11 side. As a result, plus charges are induced on the inside of the transfer paper 'P' and thus, the transfer paper 'P' is electrostatically attracted onto the transfer drum 11 by the attractive force between (i) the charge due to plus voltage applied by the power source section 32 and (ii) the minus charge on the outside of the transfer paper 'P'. In addition, since the semiconductive layer 27 is made of a semiconductor having elastic property, it is possible to realize an excellent contact between the transfer drum 11 and the ground roller 12, and to easily control not only the nip width between the transfer drum 11 and the ground roller 12, but also the nip time. Accordingly, the image forming apparatus in accordance with the present invention realizes a stable electrostatic attraction of the transfer paper 'P' onto the transfer drum 11.

Furthermore, unlike conventional arrangements, the image forming apparatus of the present invention does not adopt charge injection with use of air discharge for attraction of the transfer paper 'P' and transfer onto the transfer paper 'P'. Instead, in the image forming apparatus of the present invention, attraction of the transfer paper 'P' and transfer onto the transfer paper 'P' is carried out through charge injection and local discharge at the nip between the dielectric layer 28 and the ground roller 12, which permits low voltage drive and easy voltage control, and also reduces the driving energy. In addition, this configuration prevents any occurrence of the variation in voltage due to external pressure. Thus, according to the present invention, since the voltage applied to the transfer drum 11 is constantly kept without being influenced by environmental conditions such as humidity and temperature, it is possible to eliminate variations in the surface potential of the transfer drum 11, thereby preventing unsatisfactory attraction of the transfer paper 'P' and disorder of the transferred image. Consequently, the transfer efficiency and the image quality are improved. Occurrence of ozone is also diminished.

Moreover, since the image forming apparatus of the present invention charges (electrifies) the surface of the transfer drum 11 more stably, in comparison with the conventional one in which charging is carried out through the induction of charges onto the surface of the transfer drum 11 by the air discharge, the attraction of the transfer paper 'P' and the transfer onto the transfer paper 'P' can be carried out in a stable manner.

Furthermore, unlike the conventional structure, it is not necessary to use a plurality of chargers to apply the voltage, because the application of the voltage to only one region is sufficient for the image forming apparatus of the present invention. It is therefore possible to simplify the apparatus and to reduce the manufacturing cost.

There are described above novel features which the skilled man will appreciate give rise to advantages. These are each independent aspects of the invention to be covered by the present application, irrespective of whether or not they are included within the scope of the following claims.

What is claimed is:

1. An image forming apparatus comprising:

an image carrier for carrying a toner image formed on a surface thereof, transfer means for transferring the toner image formed on the image carrier onto a transfer paper, by bringing said transfer paper into contact with the image carrier, said transfer means having a dielectric layer, a semiconductive layer and a conductive layer arranged in this order from a side of a surface coming in contact with the transfer paper, voltage application means connected to the conductive layer, for application of a predetermined voltage to said conductive layer, and potential difference generating means provided on an upstream side of a transfer position on a surface of the dielectric layer with respect to a carrying direction of the transfer paper, said potential difference generating means coming in contact with the surface of the dielectric layer through the transfer paper and generating a potential difference between the transfer paper and the conductive layer to which the voltage is applied, wherein the semiconductive layer is made of a foaming body having elastic property, and a diameter of foams in the semiconductive layer is controlled within a predetermined range so that charge is successively supplied from a potential difference generating means side to a transfer means side even after Paschen's discharge of from the transfer means side to the potential difference generating means side.

2. The image forming apparatus as set forth in claim 1, wherein the diameter of foams in the semiconductive layer is controlled within the range of between 200 $\mu$m and 400 $\mu$m.

3. The image forming apparatus as set forth in claim 1, wherein said potential difference generating means is a grounded electrode member.

4. The image forming apparatus as set forth in claim 1, wherein said semiconductive layer is formed by urethane rubber.

5. The image forming apparatus as set forth in claim 1, wherein said dielectric layer is formed by polyvinylidene fluoride.

6. The image forming apparatus as set forth in claim 1, wherein a volume resistivity of said semiconductive layer is set to be within the range of between $10^8$ Ω·cm and $10^{11}$ Ω·cm.

7. The image forming apparatus as set forth in claim 1, wherein a volume resistivity of said dielectric layer is set to be within the range of between $10^9$ Ω·cm and $10^{15}$ Ω·cm.

8. The image forming apparatus as set forth in claim 1, further comprising pre-curl means for giving a curvature along a shape of said transfer means to the transfer paper supplied between said transfer means and said potential difference generating means.

9. The image forming apparatus as set forth in claim 1, further comprising cleaning means for removing a residual toner on the surface of said transfer means.

10. An image forming apparatus comprising:

an image carrier for carrying a toner image formed on a surface thereof, transfer means for transferring the toner image formed on the image carrier onto a transfer paper, by bringing said transfer paper into contact with the image carrier, said transfer means having a dielectric layer, a semiconductive layer and a conductive layer arranged in this order from a side of a surface coming in contact with the transfer paper, voltage application means connected to the conductive layer, for application of a predetermined voltage to said conductive layer, and potential difference generating means provided on an upstream side of a transfer position on a surface of the dielectric layer with respect to a carrying direction of the transfer paper, said potential difference generating means coming in contact with the surface of the dielectric layer through the transfer paper and generating a potential difference between the transfer paper and the conductive layer to which the voltage is applied, wherein an average distance of between the semiconductive layer and the dielectric layer is controlled within a predetermined range so that charge is successively supplied from a potential difference generating means side to a transfer means side even after Paschen's discharge of from the transfer means side to the potential difference generating means side.

11. The image forming apparatus as set forth in claim 10, wherein the semiconductive layer is made of a foaming body having elastic property, and the average distance of between the semiconductive layer and the dielectric layer is set to be within the range of between 20 $\mu$m and 50 $\mu$m.

12. The image forming apparatus as set forth in claim 11, wherein said semiconductive layer is formed by urethane rubber.

13. The image forming apparatus as set forth in claim 11, wherein a rough is formed on a surface of said dielectric layer on a side of the semiconductive layer.

14. The image forming apparatus as set forth in claim 13, wherein an embossing is carried out on the surface of said dielectric layer on the side of the semiconductive layer.

15. The image forming apparatus as set forth in claim 10, wherein (i) the semiconductive layer is made of a non-foaming body having elastic property, (ii) a rough is formed on at least one surface of surfaces facing each other of the semiconductive layer and the dielectric layer, and (iii) the average distance of between the semiconductive layer and the dielectric layer is set to be within the range of between 20 $\mu$m and 50 $\mu$m.

16. The image forming apparatus as set forth in claim 15, wherein said semiconductive layer is formed by silicon.

17. The image forming apparatus as set forth in claim 10, wherein said potential difference generating means is a grounded electrode member.

18. The image forming apparatus as set forth in claim 10, wherein a volume resistivity of said semiconductive layer is set to be within the range of between $10^8$ Ω·cm and $10^{11}$ Ω·cm.

19. The image forming apparatus as set forth in claim 10, wherein a volume resistivity of said dielectric layer is set to be within the range of between $10^9$ Ω·cm and $10^{15}$ Ω·cm.

* * * * *